US007287511B2

(12) United States Patent
Matsuda

(10) Patent No.: US 7,287,511 B2
(45) Date of Patent: Oct. 30, 2007

(54) ENGINE FOR LEISURE VEHICLE

(75) Inventor: Yoshimoto Matsuda, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/529,557

(22) Filed: Sep. 27, 2006

(65) Prior Publication Data

US 2007/0068490 A1 Mar. 29, 2007

(30) Foreign Application Priority Data

Sep. 28, 2005 (JP) ..... 2005-282435

(51) Int. Cl.
*F02D 9/10* (2006.01)

(52) U.S. Cl. ..... 123/399

(58) Field of Classification Search ..... 123/399, 123/361

See application file for complete search history.

(56) References Cited

U.S. PATENT DOCUMENTS

RE33,027 E * 8/1989 Danno et al. ..... 123/361
5,408,899 A * 4/1995 Stewart ..... 123/399
6,935,308 B1 * 8/2005 Nakamoto et al. ..... 123/399
2007/0107694 A1 * 5/2007 Grossmann et al. ..... 123/399

FOREIGN PATENT DOCUMENTS

JP 01-227838 9/1989

* cited by examiner

*Primary Examiner*—Erick Solis
(74) *Attorney, Agent, or Firm*—Alleman Hall McCoy Russell & Tuttle LLP

(57) ABSTRACT

An engine for a leisure vehicle equipped with an electronic control throttle system configured to operate an actuator based on a drive signal sent from a controller to the actuator in response to a rider's operation of a throttle operation device to cause a throttle valve of an air-intake device to open or close, including a first throttle position sensor configured to detect a movement position of the throttle valve; and a detection device configured to detect at least a predetermined position in an open state or a closed state of the throttle valve; wherein the controller determines a deviation between the predetermined position and the movement position of the throttle valve, compensates for a deviation by adjusting the drive signal based on a deviation if the deviation is above a preset value, and sends the adjusted drive signal to the actuator to cause the throttle valve to open or close.

9 Claims, 7 Drawing Sheets

ENGINE FOR LEISURE VEHICLE

TECHNICAL FIELD

The present invention generally relates to an engine for a leisure vehicle such as a two-wheeled motor vehicle, a three-wheeled motor vehicle, an all terrain vehicle (ATV), personal watercraft, etc.

BACKGROUND ART

In an engine for a leisure vehicle such as a two-wheeled motor vehicle, a three-wheeled motor vehicle, an all terrain vehicle (ATV), personal watercraft, etc., an air-intake device is mounted to supply fresh air to a combustion chamber of the engine.

A throttle valve is openably disposed in an interior of an air-intake passage of the air-intake device to control a supply amount of the fresh air. The throttle valve is moved by a throttle operation device (e.g., throttle lever, a rotatable throttle grip, and so on) configured to be hand-operated by a rider (see Japanese Laid-Open Patent Application Publication No. Hei. 1-227838).

Generally, there are two types of throttle valve drive systems, namely, mechanical drive systems and drive-by-wire systems. In mechanical drive systems, the throttle operation device is mechanically coupled to the throttle valve via a wire or a rod. In the drive-by-wire system, a controller remotely controls an actuator disposed in the vicinity of the throttle valve based on an operation signal such as an electric signal or an optical signal generated by an operation of the throttle operation device, causing the throttle valve to open and close. In some cases, the drive-by-wire system is distinguished from so-called "fly-by-light" systems, which use an optical signal as the operation signal. However in this specification, drive-by-wire systems and fly-by-light systems are treated in the same manner and collectively referred to as drive-by-wire systems.

Since a drive-by-wire system is configured in such a manner that an electronic controller generates a drive signal based on the operation signal to drive the actuator, it may also be referred to as an "electronic control throttle system." Thus, the term "electronic control throttle system" is used through specification and claims.

Hereinafter, electronic control throttle systems will be described in detail. Upon the rider operating the throttle operation device, a sensor such as a throttle position sensor detects that the throttle operation device has been operated, and sends the detected operation signal, for example, a position signal, to an electronic controller such as an engine control unit (ECU) of the leisure vehicle through a signal line, etc. The electronic controller generates the drive signal based on the operation signal, and outputs the drive signal to the actuator to operate the actuator, causing the throttle valve of the air-intake device to open and close.

A throttle position sensor is attached to a movable member of the throttle valve of the air-intake device or a region in close proximity to the movable member. The throttle position sensor is configured to detect an open position or a closed position of the throttle valve.

Strictly speaking, the electronic control throttle system configured as described above contains a slight "deviation" associated with the control as compared to the mechanically coupled throttle system. The deviation is not substantially problematic to the rider in a high engine speed range, but makes the rider feel discomfort in a low engine speed range. For example, the deviation negatively affects responsiveness to the rider's operation just after cornering. For this reason, the leisure vehicle equipped with such an electronic control throttle system is comparatively low in responsiveness to rider control.

SUMMARY OF THE INVENTION

The present invention addresses the above described conditions, and an object of the present invention is to provide an engine for a leisure vehicle that is equipped with an electronic control throttle system which is capable of compensating for deviation between rider input and throttle valve position, to improve responsiveness to a rider's operation of the throttle operation device.

According to the present invention, there is provided an engine for a leisure vehicle equipped with an electronic control throttle system configured to operate an actuator for driving a throttle valve based on a drive signal sent from a controller to the actuator in response to a rider's operation of a throttle operation device to cause the throttle valve of an air-intake device to open or close, the engine comprising a first throttle position sensor configured to detect a movement position of the throttle valve; and a detection device configured to detect at least a predetermined position in an open state or a closed state of the throttle valve; wherein the controller determines, typically by computing or calculating, a deviation between the at least predetermined position received from the detection device and the movement position of the throttle valve corresponding to the predetermined position that has been detected by the first throttle position sensor, compensates for a deviation by adjusting the drive signal based on the deviation if the deviation is above a preset value, and sends the adjusted drive signal to the actuator to cause the throttle valve to open or close.

In accordance with the engine for the leisure vehicle as constructed above, the controller cause the actuator to operate according to the drive signal associated with a value of the deviation to compensate for the deviation of the movement position of the throttle valve, when the value of the deviation is larger than a predetermined value. As a result, the engine can run with high responsiveness to the rider's operation of the throttle operation device.

The detection device may be an ON-OFF switch, and the predetermined position may be obtained from an on-state or off-state of the ON-OFF switch. Such a construction is simple and inexpensive. In addition, reliability of the electronic control throttle system improves.

The detection device may be a negative pressure sensor configured to detect a negative pressure in a region downstream of the throttle valve of an air-intake passage of the air-intake device, and the predetermined position may be obtained from the value detected by the negative pressure sensor.

The detection device may be a second throttle position sensor disposed on or in close proximity to a movable member of the throttle valve, and the predetermined position may be obtained from the value detected by the second throttle position sensor. With such a construction, precise compensation may be executed.

Typically, the detecting precision of the second throttle position sensor is higher than the detecting precision of the first throttle position sensor. By configuring so that a detecting range of the second throttle position sensor conforms to an engine speed range for which compensation is frequently demanded, precise detection and the associated precise compensation are desirably executed in the detecting range. Since the first throttle position sensor with a lower detecting precision detects a whole range of the movement position of the throttle valve, an inexpensive electronic control system may be achieved.

The controller may adjust the drive signal based on the deviation such that a compensation amount per unit time increases as a value of the deviation increases. This provides the rider with good drivability.

The controller may be configured to decrease at least one of the number of times of ignition and a fuel feed amount as well as adjust the drive signal, when a value of the deviation is positive and the drive signal is adjusted to decrease an engine speed of the engine.

The controller may be configured to determine a rate of decrease in the engine speed per unit time that is associated with the compensation, based on the engine speed at that point of time such that the rate decreases as the engine speed decreases. Since acceleration in the longitudinal direction of the motorcycle becomes smaller, the rider or passenger can obtain good riding feeling.

The predetermined position may be a slight open position of the throttle valve. This provides the rider or passenger with good drivability during starting, stopping, and cornering.

The above and further objects and features of the invention will more fully be apparent from the following detailed description with accompanying drawings.

DETAILED DESCRIPTION OF THE PREFERRED EMBODIMENTS

Hereinafter, an embodiment of an engine for a leisure vehicle will be described with reference to the accompanying drawings. By way of example, the engine will be described as mounted in a motorcycle.

Figure 1:
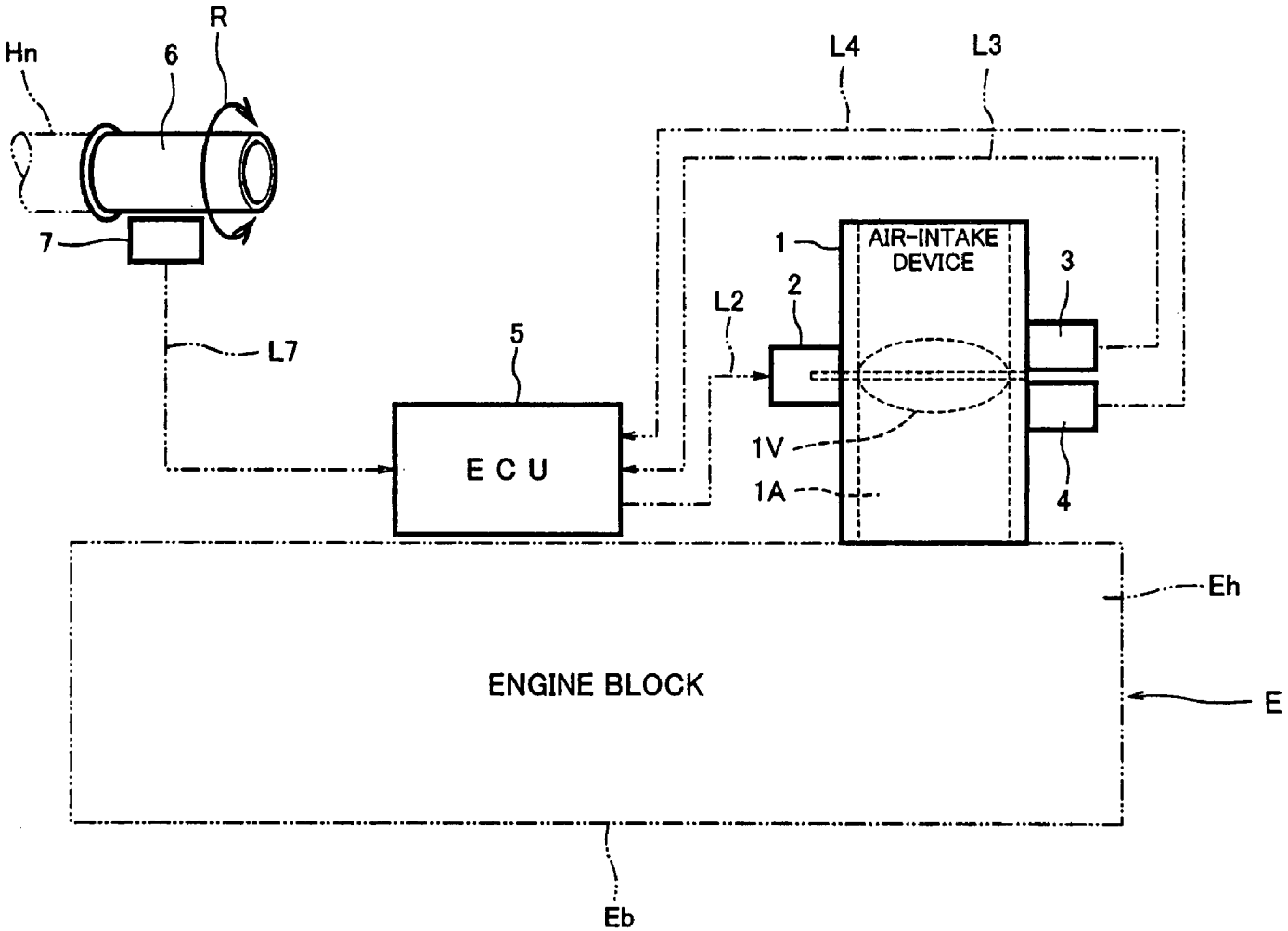
FIG. 1 is a conceptual diagram showing a construction of an engine for a motorcycle equipped with a throttle device according to an embodiment of the present invention.

Turning now to FIG. 1, an air-intake device 1 is mounted to each cylinder head Eh of an engine block Eb constituting a part of the engine E of this embodiment. As indicated by a broken line of FIG. 1, a throttle valve (or valve) 1V is mounted in an air-intake passage 1A in the interior of the air-intake device 1 such that the throttle valve 1V is pivotable within a predetermined angle. According to an opening degree of the throttle valve 1V, a fuel injection amount is increased or decreased. An engine speed of the engine E increases and decreases by opening and closing the throttle valve 1V, respectively. By moving the throttle valve 1V to a fully closed position, the engine E turns to an idling state.

An electric actuator (actuator for operating the throttle valve) 2 is mounted outside the air-intake device 1 and in close proximity to the throttle valve 1V of the air-intake device 1 and is configured to cause the throttle valve 1V to be pivoted, i.e., opened and closed. The throttle valve 1V of the air-intake device 1 may be directly moved by the actuator 2, or otherwise a wire, a rod, etc may be provided between them to transmit the operation of actuator 2 to the throttle valve 1V.

A first throttle position sensor 3 and a second throttle position sensor (detection device) 4 are attached to a region of the air-intake device 1 in close proximity to the throttle valve 1V. The first throttle position sensor 3 and the second throttle position sensor 4 are configured to detect a rotational position (rotational angle) or a movement position of the throttle valve 1V. In this embodiment, the second throttle position sensor 4 is able to detect the rotational position of the throttle valve 1V more precisely than the first throttle position sensor 3. In this embodiment, for example, the precision with which the second throttle position sensor 4 detects the rotational position of the throttle valve 1V is about five times as high as the precision with which the first throttle position sensor 3 detects the rotational position of the throttle valve 1V. The value "five times" is merely exemplary, and other values, for example, three times or eight times may be used so long as the detecting precision of the second throttle position sensor 5 is as high as or higher than the detecting precision of the first throttle position sensor 3.

In addition, the first throttle position sensor 3 has a sensing range to be detected that is larger than that of the second throttle position sensor 4. To be specific, the first throttle position sensor 3 is capable of detecting the rotational position or rotational angle in a whole moving range of the valve 1, whereas the second throttle position sensor 4 is capable of detecting the movement position or the rotational angle in a smaller moving range corresponding to a low engine speed range from an idling engine speed to an engine speed slightly higher than the idling engine speed, for example, from a fully closed position of the valve 1C which is a greatest-degree closed state of the throttle valve 1V, to an open position that is open to about 10 degrees from the fully closed position. The value "10 degrees" is merely exemplary, and other degree values may be adopted so long as the sensing range of the second throttle position sensor 4 is as large as or smaller than that of the first throttle position sensor 3. By using the first throttle position sensor 3 with lower detecting precision and the second throttle position sensor 4 with higher detecting precision, a low production cost can be achieved.

The first throttle position sensor 3 is communicatively coupled to a controller 5 through a signal line L3, and the second throttle position sensor 4 is communicatively coupled to the controller 5 through a signal line L4 so that data indicating the rotational position detected by the first throttle position sensor 3 and data indicating the rotational position detected by the second throttle position sensor 4 are communicated to the controller 5. In this embodiment, the controller 5 is an ECU (engine control unit) of the engine E. In addition to the ECU, a controller that is separate from the ECU, such as a controller that is exclusively provided for the electronic throttle device, may be used as the controller 5.

The actuator 2 is communicatively coupled to the controller 5 through a signal line L2. The controller 5 is configured to output a drive signal to the actuator 2 to operate the actuator 2 in a desired manner.

The throttle operation device may be provided in the form of a throttle grip 6. The throttle grip 6 is attached to an end portion of a bar-type steering handle Hn of the motorcycle B (see FIG. 6) and is configured to be rotatable within a predetermined angle, for example, 70 degrees. The rider rotates the throttle grip 6 as indicated by an arrow R to open or close the throttle valve 1V of the air-intake device 1, thereby obtaining a desired engine speed, as described later. A grip position sensor 7 is attached in close proximity to the throttle grip 6, and is configured to detect a rotational angle (operation angle) of the throttle grip 6. The grip position sensor 7 is communicatively coupled to the controller 5 through a signal line L7 and is configured to communicate data indicating the detected rotational angle to the controller 5.

Figure 2:
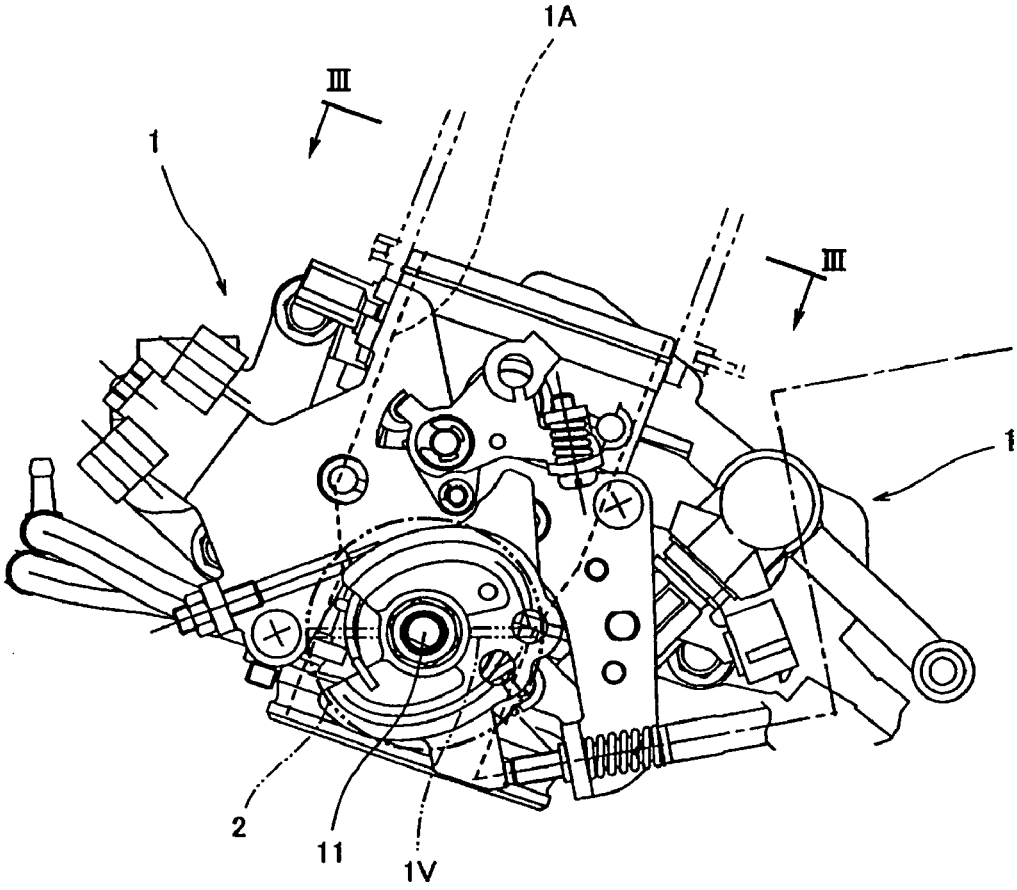
FIG. 2 is a side view of an air-intake device for the engine of FIG. 1.
Figure 3:
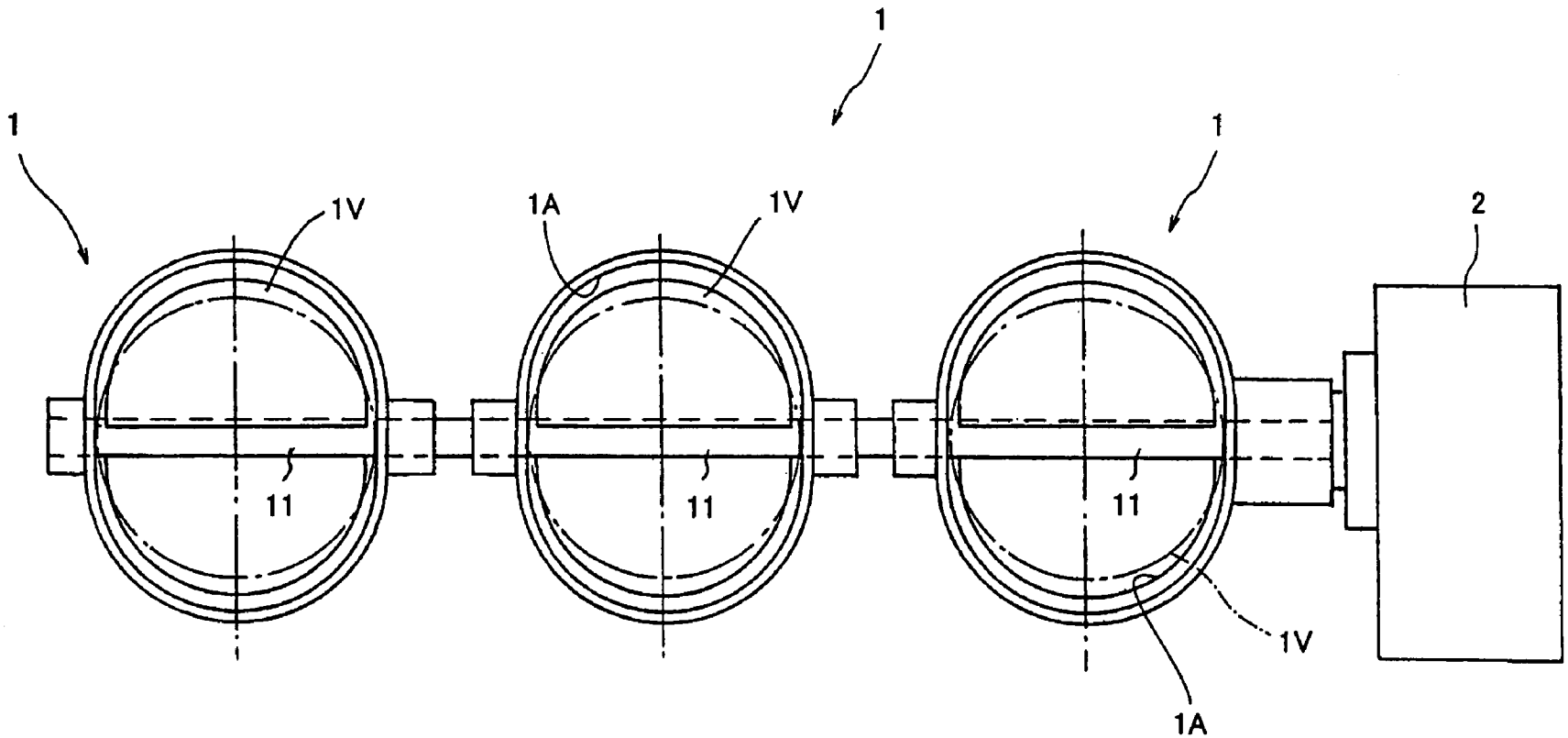
FIG. 3 is a plan view of the air-intake device of FIG. 2 in the direction of arrows along line III-III of FIG. 2.

FIG. 2 illustrates a side view of a construction of the air-intake device 1. FIG. 3 illustrates a view taken in the direction of arrows along line III-III of FIG. 2. As shown in FIGS. 2 and 3, the throttle valve 1V of the air-intake device 1 is pivotally mounted to a rotational shaft 11 that is rotatable within a predetermined angle. In this embodiment, the rotational shaft 11 is a common shaft which is rotatable to open and close the valves 1V of the plurality of air-intake devices 1 together. Alternatively, the rotational shafts 11 may be respectively provided to correspond to the throttle valves 1V. A rotational shaft of the actuator 2 is coupled to an end of the rotational shaft 11 to be integrally rotatable. The actuator 2 rotates to open and close the throttle valve 1V of the air-intake device 1.

Figure 4:
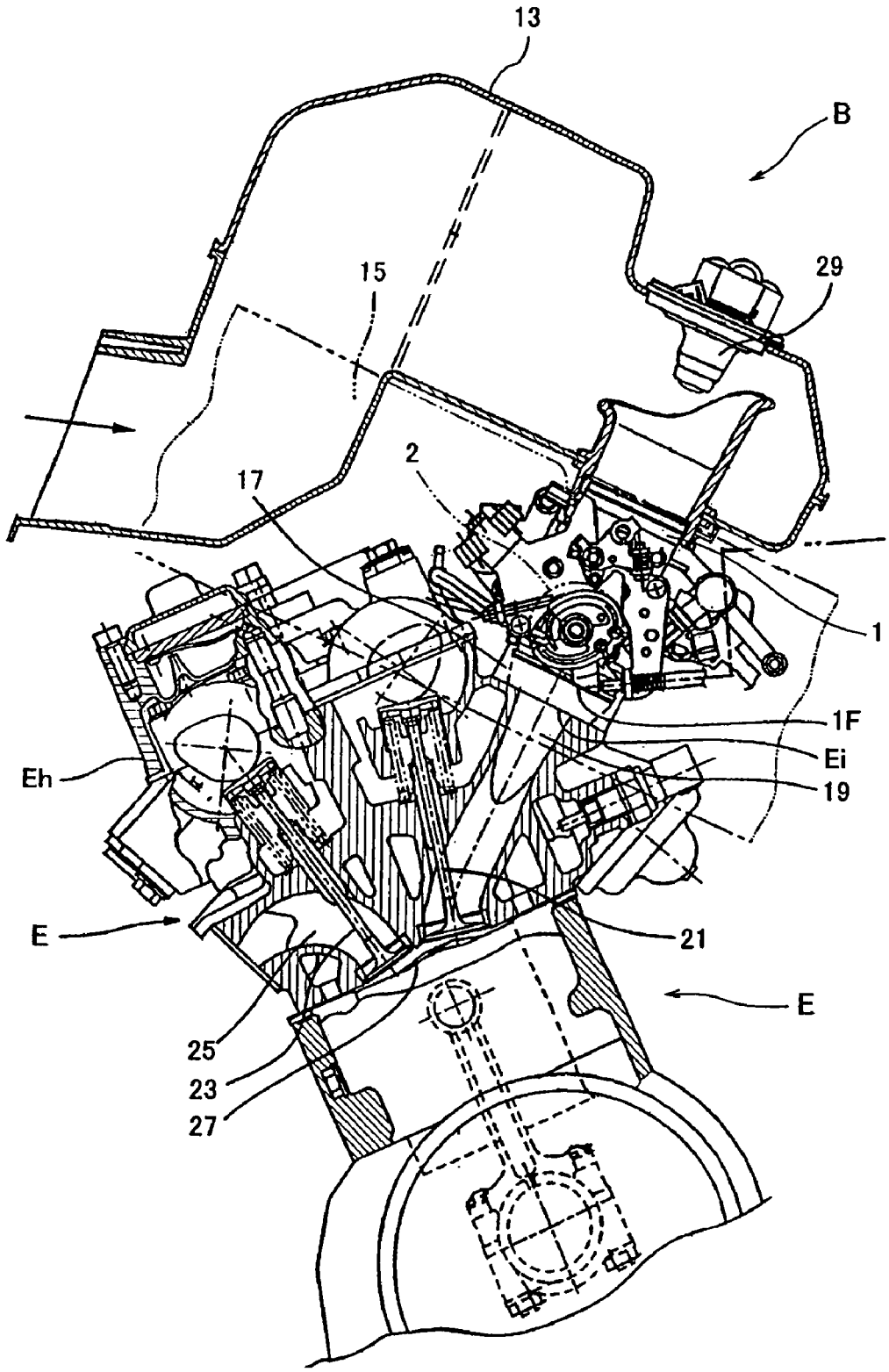
FIG. 4 is a partial cross-sectional side view of the engine for the motorcycle equipped with the air-intake device of FIGS. 2 and 3.
Figure 6:
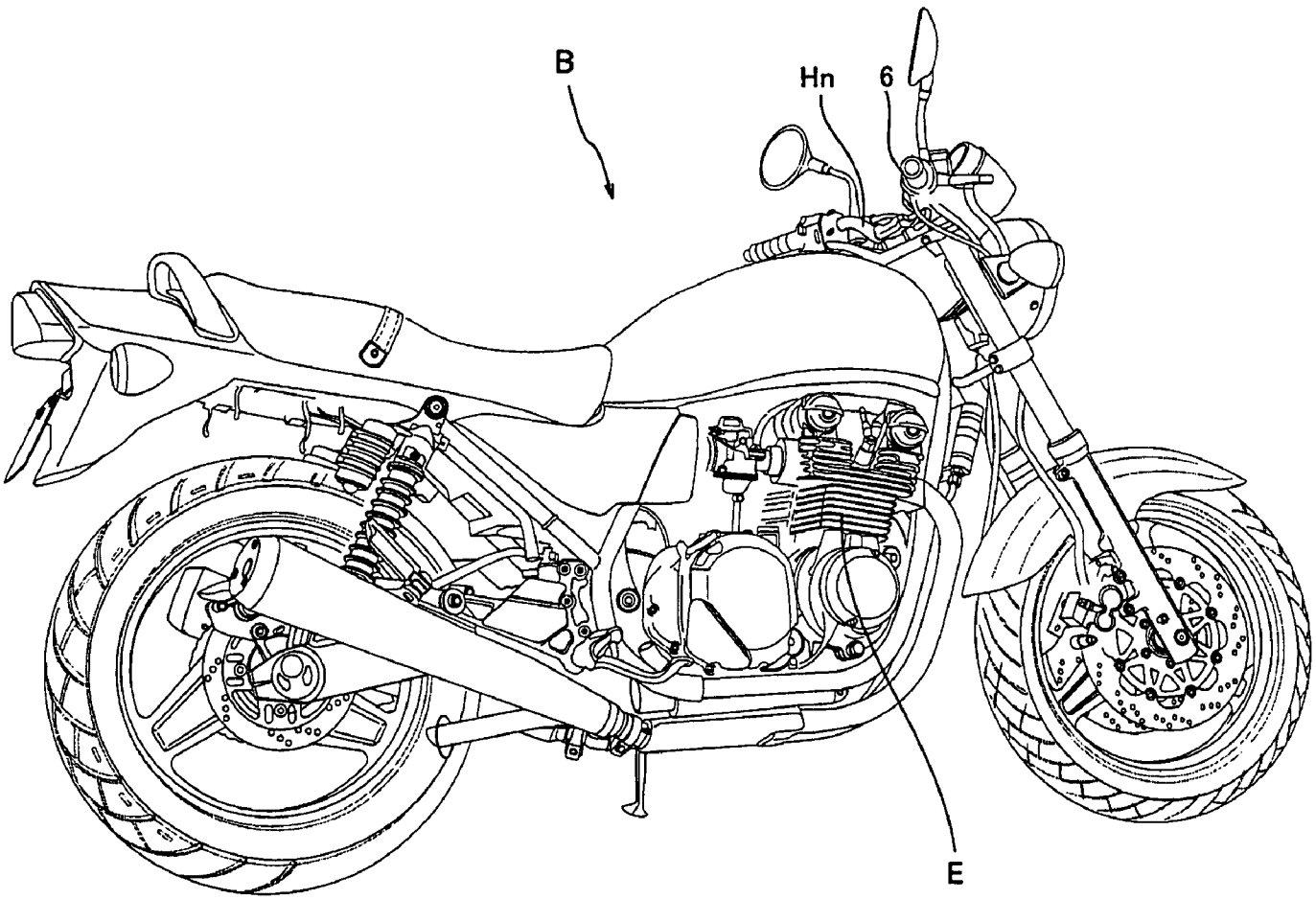
FIG. 6 is a side view of the motorcycle equipped with the engine of FIG. 4.

The air-intake device 1 of FIGS. 2 and 3 is mounted to the engine E of the motorcycle B as illustrated in FIG. 4. Turning to FIG. 4, an air-intake box (air cleaner) 13 is configured to supply the fresh air to the air-intake device 1. A main frame member 15 is a part of a frame of the motorcycle B (FIG. 6). Reference symbol Eh denotes the cylinder head of the engine E. An insulator 17 is mounted between the air-intake device 1 and the cylinder head Eh to mount the air-intake device 1 to the cylinder head Eh. The air-intake passage 19 is formed in the interior of the cylinder head Eh. Reference number 21 denotes an intake valve of the engine E. Reference number 23 denotes an exhaust valve of the engine E. An exhaust passage 25 is formed in the interior of the cylinder head Eh. Reference number 27 denotes a combustion chamber of the engine E. A fuel injection device 29 is configured to inject a fuel into the air-intake passage 1A (FIG. 2) of the air-intake device 1. Reference number 1F denotes an end of the air-intake device 1.

Figure 5:
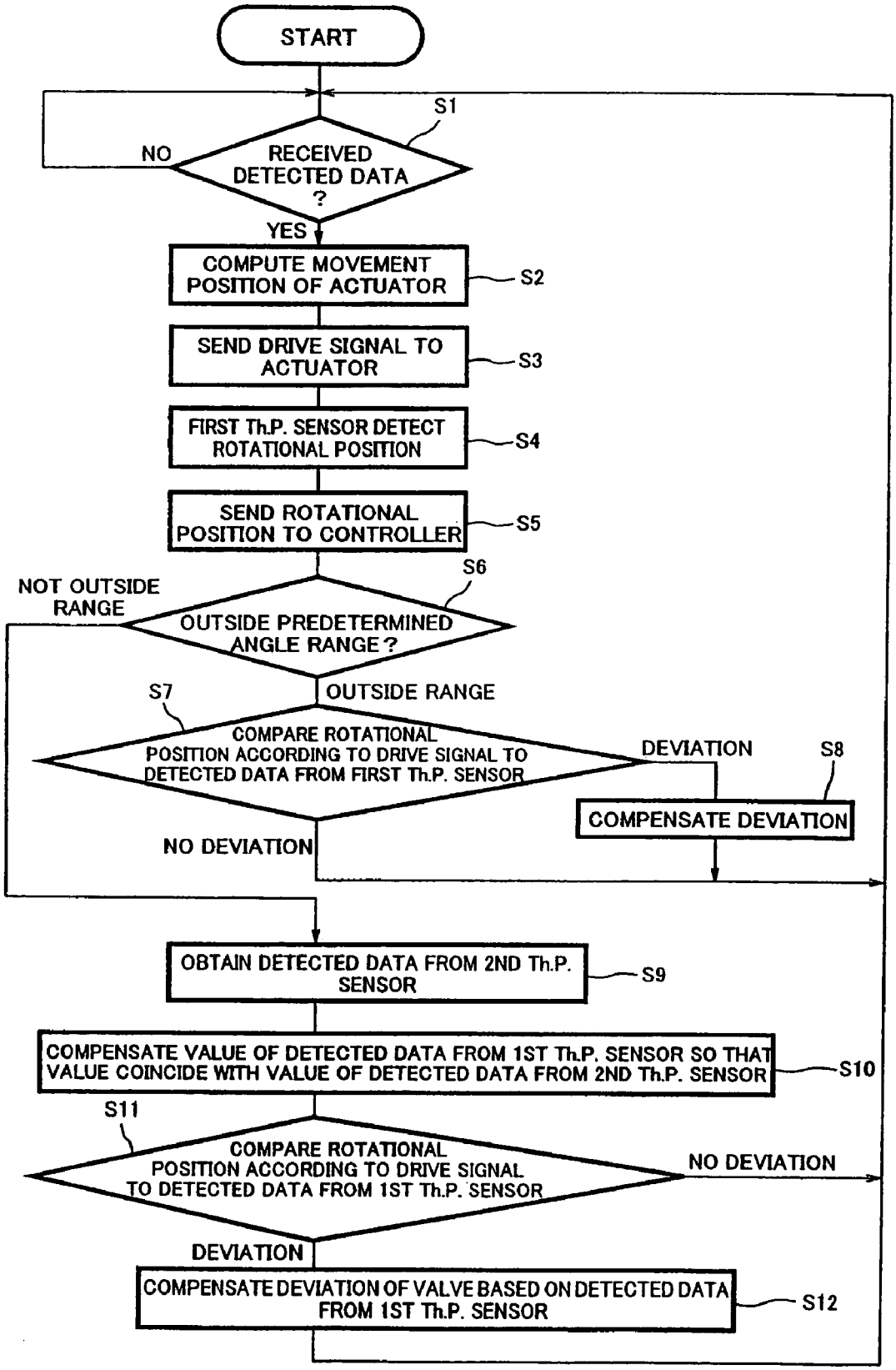
FIG. 5 is a flowchart showing a control process of a controller equipped in the engine.

The engine E as constructed above is mounted in the motorcycle B of FIG. 6 and operates as follows. Below, the operation of the engine E will be described along with the process flow of a program stored in the controller 5 that is illustrated in the flowchart of FIG. 5 and with reference to FIGS. 1 to 4.

Here, it is assumed that the rider has operated the throttle grip 6 to decelerate the engine E during travel of the motorcycle B. The grip position sensor 7 detects a rotational position to which the throttle grip 6 has been rotated and communicates data indicating the detected rotational position to the controller 5 through the signal line L7. The controller 5 determines whether or not it has newly received the detected data indicating the rotational angle of the throttle grip 6 from the grip position sensor 7 for each of a suitable number of clock counts (step 1: S1). If it is determined that it has newly received the detected data in step 1 (YES), the controller 5 computes a movement position of the actuator 2 based on the detected data or calculates the movement position with reference to a table (step 2: S2). Then, the controller 5 sends data indicating the movement position found by computation, calculation, or the like, as a drive signal to the actuator 2 through the signal line L2 (step 3: S3). Receiving the drive signal, the actuator 2 moves to the movement position indicated by the drive signal to open or close the throttle valve 1V to a predetermined angle. The first throttle position sensor 3 detects a rotational position (absolute rotational position) of the throttle valve 1V resulting from the opening or closing operation (step 4: S4) and communicates the detected rotational position to the controller 5 through the signal line L3 (step 5: S5). The controller 5 detects whether or not the second throttle position sensor 4 has operated to determine whether or not the throttle valve 1V is outside a predetermined angle range which is unable to be detected by the second throttle position sensor 4 (step 6: S6). If it is determined that the throttle valve 1V is outside the predetermined angle range, i.e., in an angle range or an opening degree range in which the second position senor 4 does not operate, the controller 6 executes "non-slight opening control mode." In the non-slight opening control mode, the controller 5 compares the detected data indicating the rotational position of the throttle valve 1V from the first throttle position sensor 3 to the data indicating the rotational position of the throttle valve V according to the drive signal sent to the actuator 2 (step 7: S7), and determines that there is a deviation between them, if the deviation is a predetermined value or more, for example, 5 degrees or more. To compensate for the deviation, the controller 5 sends a drive signal to the actuator 2 again to move the actuator 2 by an amount corresponding to the deviation, thereby causing the throttle valve 1V to move so as to compensate for the deviation (S8:S8), and returns the process to step 1. The term "5 degrees or more" is merely exemplary, but other suitable numeric values, for example, 2 degrees or more, may be adopted. In a non-slight open state of the throttle valve 1V, a time lag may be great. However, the presently described process compensates for this time lag, and as a result problematic responsiveness to rider input is inhibited, even if a substantial time lag occurs.

If it is determined that the second throttle position sensor 4 has operated in step 6, for example, the throttle valve 1V is in an open position that is open to 5 degrees from the fully closed position, the controller 5 executes a slight opening control mode. To be specific, the controller 5 obtains the detected data indicating the rotational position of the throttle valve 1V from the second throttle position sensor 4 (step 9: S9). Then, the controller 5 compensates by adjusting a value of the detected data indicating the rotational position from the first throttle position sensor 3 so that that value becomes equal to a value of the detected data indicating the rotational position of the throttle valve 1V from the second throttle position sensor 4 (step 10: S10).

Then, the controller 5 compares the value of the compensated detected data to the value of the data sent to the actuator 2 as the drive signal (step 11: S11), and determines that there is a deviation between them, if the deviation is a predetermined value or more, for example, 1 degree or more. To compensate for the deviation, the controller 5 sends a drive signal to the actuator 2 again to move the actuator 2 by an amount corresponding to the deviation, thereby causing the throttle valve 1V to move to the rotational position according to the drive signal sent to the actuator 2 (step 12: S12). For example, if the opening degree of the throttle valve 1V is larger than the value of the data indicating the rotational position of the throttle valve 1V according to the drive signal sent from the controller 5 to the actuator 2, i.e., the value of the deviation is positive, a compensation is made by decreasing the engine speed. It should be appreciated that the open position that is open to 5 degrees in step 9 from the fully closed position is merely exemplary and other suitable degrees, for example, 3 degrees may be adopted. In addition, the magnitude of the deviation, 1 degree or more in step 12, is merely exemplary, and other suitable degrees, for example, 0.8 degree or more, may be adopted. The slight-opening control mode is executed in a range in which good drivability is especially demanded. The values used for the slight opening control mode may be suitably decided depending on characteristics of the engine E or a vehicle body of the motorcycle B so that good drivability is obtained.

If it is determined that the value of the deviation is a certain value or more in step 11, for example, 3 degrees or more in the opening degree of the throttle valve 1V, the controller 5 executes step 12 and decreases one or both of the number of times of ignition and a fuel feed amount for a predetermined number of cylinders, for example, one cylinder or two cylinders in the four-cylinder engine. This may desirably quickly compensate for the deviation of the opening degree of the throttle valve 1V that may negatively affect the engine speed, to improve fuel efficiency.

In the engine E of the motorcycle B, compensation is desirably executed so that a compensation amount per unit time is larger when the value of the deviation is larger. As a result, a change of an engine speed that is highly responsive to the rider's operation of the throttle grip 6 can be achieved.

If the compensation is executed to cause the throttle valve 1V to close, i.e., to decrease the engine speed E, an operation amount of the opening degree of the throttle valve 1V per unit time, i.e., a rate of decrease in the engine speed per unit time, is changed in proportion to the magnitude of the opening degree of the throttle valve 1V (or engine speed) at that point of time. This desirably gradually decreases the engine speed. To be specific, by executing the control so that the rate of decrease in the engine speed decreases as the opening degree of the throttle valve 1V decreases, i.e., when the engine speed is lower, a gradually decreased engine speed conforming to a low engine speed range can be obtained.

Regardless of whether the non-slight opening control mode or the slight opening control mode is executed, the engine speed of the engine E is desirably quickly decreased by moving the throttle valve 1V to the closed position and by decreasing one of or both of the number of times of ignition or the fuel feed amount. Such control to decrease the engine speed quickly is effective when the engine E is running at a relatively high engine speed.

In the engine E constructed above, at the start of the operation of the second throttle position sensor 4, the value of the detected data indicating the rotational position of the throttle valve 1V from the first throttle position sensor 3 is compensated to coincide with the value of the detected data indicating the rotational position of the throttle valve 1V from the second throttle position sensor 4. In the slight opening degree range of the throttle valve 1V, i.e., the low engine speed range of the engine E, the slight opening control mode is able to control the rotational position of the throttle valve 1V of the air-intake device 1 to achieve a very small allowable deviation. Such an engine is highly responsive to the rider's slight throttle operation in the low engine speed range of the motorcycle B, and thus is able to produce good drivability. As a result, the engine is accelerated or decelerated to precisely respond to the rider's throttle grip operation to a certain range from start of the opening operation of the throttle grip 6 or before completion of the closing operation of the throttle grip 6.

In this embodiment, step 10 may be omitted, and in step 11, the value of the data indicating the rotational position of the throttle valve 1V according to the drive signal sent from the controller 5 to the actuator 2 may be compared to the value of the detected data from the second throttle position sensor 4, instead of the value of the detected data from the first throttle position sensor 3. This desirably decreases the number of steps.

Figure 7:
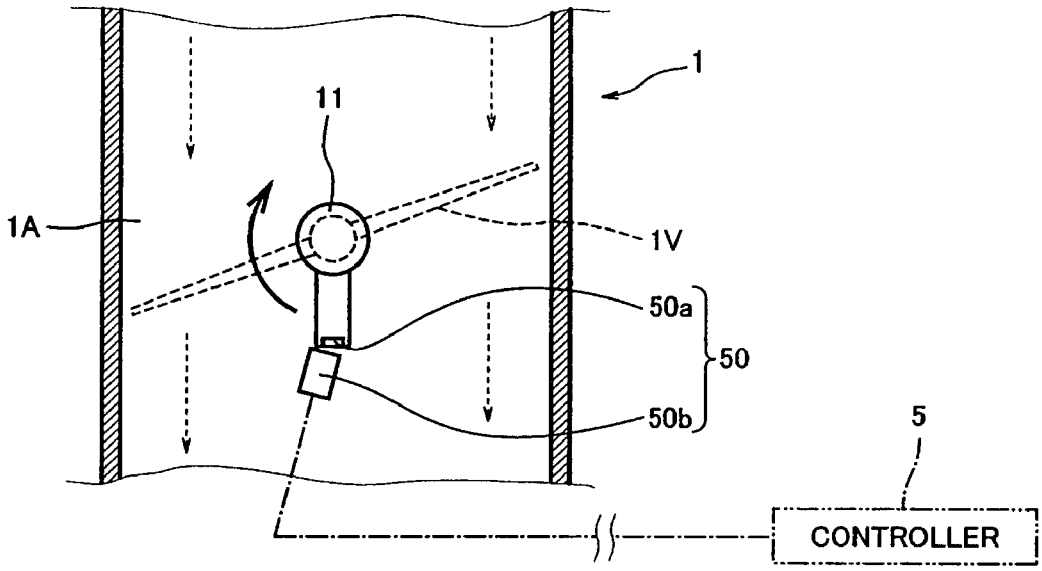
FIG. 7 is a view showing a schematic construction of a detection device according to another embodiment.

As an alternative to the second throttle position sensor 4 used as the detection device, an ON-Off switch may be used. To be specific, as shown in FIG. 7, an ON-OFF switch 50 may include a member 50*a*, for example, a permanent magnet that is attached to the rotational shaft 11 of the throttle valve 1V, and a member 50*b* that is responsive to a magnetic force of the permanent magnet and is attached to, for example, a throttle body side so that the switch 50 is switched to an ON state when the throttle valve 1V is in a position near the fully closed position. The member 50*b* of the ON-OFF switch 50 is communicatively coupled to the controller 5. The controller 5 compares the value of the detected data from the first throttle position sensor 3 to an actuated position (a predetermined opening degree of the throttle valve 1V, e.g., opening degree that is open to 5 degrees from the fully closed position) of the ON-OFF switch 50 to detect a deviation between them, upon the actuation of the ON-OFF switch 50. If the deviation is a predetermined value or more, the controller 5 sends the drive signal to the actuator 2 to compensate for the deviation. The slight opening control mode may be configured to be executed upon the actuation of the ON-OFF switch 50. During the slight opening control mode, "D-J control" (control to change a fuel injection timing, an ignition timing, and so on based on a correlation between the engine speed and a boost pressure in the interior of the throttle body) may be executed, when the value of the deviation is positive and therefore compensation should be made by decreasing the engine speed. The non-slight opening control mode may be configured to be executed before the actuation of the ON-OFF switch 50. During the non-slight opening control mode, "α-N control" (control to change the fuel injection timing, the ignition timing, and so on based on a correlation between the opening degree a of the throttle valve 1V and the engine speed) may be executed, when the value of the deviation is positive and therefore compensation should be made by decreasing the engine speed.

Whereas a magnet proximity switch (non-contact switch) constructed of the members 50*a* and 50*b* as the ON-OFF switch is used in this embodiment, a contact switch may alternatively be used.

Figure 8:
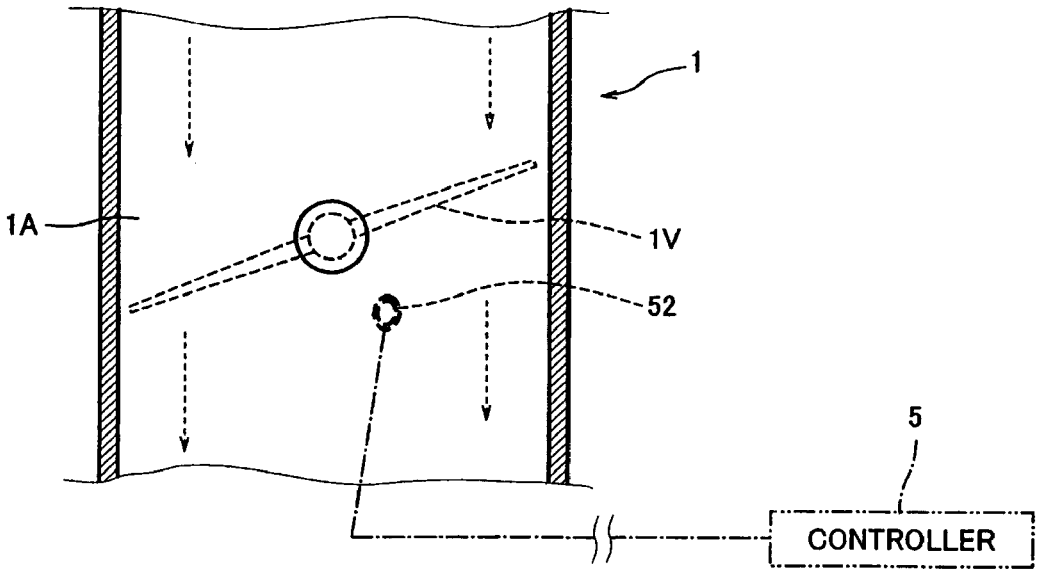
FIG. 8 is a view showing a schematic construction of a detection device according to another embodiment.

As shown in FIG. 8, instead of the second throttle position sensor 4 or the ON-OFF switch 50 as the detection device, a negative pressure sensor 52 is disposed in a region downstream of the throttle valve 1V of the air-intake device 1, and is configured to detect a pressure in the region downstream of the throttle valve 1V. The negative pressure sensor 52 is communicatively coupled to the controller 5. When the negative pressure sensor 52 detects that the negative pressure generated in the region downstream of the throttle valve 1V, under a substantially fully-closed condition, reaches a predetermined value, it outputs a signal to the controller 5. The controller 5 compares the value of the detected data from the first throttle position sensor 3 to a predetermined valve position (e.g., opening degree that is open to, for example, 5 degrees from the fully closed position) at which the negative pressure sensor 52 starts outputting the signal, to thereby detect whether or not there is a deviation between them. The controller 5 may be configured to control the actuator 2 to compensate for the deviation if the deviation is a predetermined value or more. The slight opening control mode may be configured to be executed upon the operation of the negative pressure sensor 52. When the value of deviation is positive and therefore compensation should be made by decreasing the engine speed in the slight opening control mode, the D-J control may be executed. The non-slight opening control mode may be configured to be executed before the negative pressure sensor 52 starts outputting the signal, i.e., in the range in which the throttle valve 1V is in a non-slight open position. When the value of the deviation is positive and therefore compensation should be made by decreasing the engine speed in the non-slight opening control mode, the α-N control may be executed.

Whereas the control mode is divided into the slight opening control mode and the non-slight opening control mode to correspond to the slight opening range of the throttle valve 1V and the non-slight opening range of the throttle valve 1V in this embodiment, an intermediate opening range of the throttle valve 1V may alternatively be provided between the slight opening range and the non-slight opening range so that the control mode is divided into the slight opening control mode, the intermediate opening control mode, and the non-slight opening control mode. In this case, the compensation in the slight opening control mode may be executed when the value of the deviation is between 1 degree and 3 degrees, the compensation in the intermediate opening control mode may be executed when the value of the deviation is between 3 degrees and 5 degrees, and the compensation in the non-slight opening control mode may be executed when the value of the deviation is 5 degrees or more. Such a configuration suitably conforms to an actual running state of the engine E in which the deviation tends to increase because of a time lag, and so on as the opening degree of the throttle valve 1V increases. The above illustrated degrees of the throttle valve 1V are merely exemplary, and other suitable numeric values may be adopted. It is desirable that the value of the compensating adjustments for deviations increase in the following order: the value of compensation in the slight opening control mode, the value of compensation in the intermediate opening control mode, and the value of compensation in the non-slight opening control mode.

Whereas the present invention is applied to the three-cylinder engine in the above embodiment, it may be applied to other suitable engines such as a single cylinder engine, a twin-cylinder engine, a four-cylinder engine, or a six-cylinder engine.

Furthermore, the present invention may be applied to leisure vehicles other than a motorcycle.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An engine for a leisure vehicle equipped with an electronic control throttle system configured to operate an actuator for driving a throttle valve based on a drive signal sent from a controller to the actuator in response to a rider's operation of a throttle operation device to cause the throttle valve of an air-intake device to open or close, the engine comprising:

a first throttle position sensor configured to detect a movement position of the throttle valve; and a detection device configured to detect at least a predetermined position in an open state or a closed state of the throttle valve;

wherein the controller determines a deviation between the at least predetermined position received from the detection device and the movement position of the throttle valve corresponding to the predetermined position that has been detected by the first throttle position sensor, compensates for a deviation by adjusting the drive signal based on the deviation if the deviation is above a preset value, and sends the adjusted drive signal to the actuator to cause the throttle valve to open or close.

2. The engine for a leisure vehicle according to claim 1, wherein the detection device is an ON-OFF switch, and the predetermined position is obtained from an on-state or an off-state of the ON-OFF switch.

3. The engine for a leisure vehicle according to claim 1, wherein the detection device is a negative pressure sensor configured to detect a negative pressure in a region downstream of the throttle valve of an air-intake passage of the air-intake device, and the predetermined position is obtained from the value detected by the negative pressure sensor.

4. The engine for a leisure vehicle according to claim 1, wherein the detection device is a second throttle position sensor disposed on or in close proximity to a movable member of the throttle valve, and the predetermined position is obtained from the value detected by the second throttle position sensor.

5. The engine for a leisure vehicle according to claim 4, wherein detecting precision of the second throttle position sensor is higher than detecting precision of the first throttle position sensor.

6. The engine for a leisure vehicle according to claim 1, wherein the controller adjusts the drive signal based on the deviation such that a compensation amount per unit time increases as a value of the deviation increases.

7. The engine for a leisure vehicle according to claim 1, wherein the controller is configured to decrease at least one of the number of times of ignition and a fuel feed amount as well as adjust the drive signal, when a value of the deviation is positive and the drive signal is adjusted to decrease an engine speed of the engine.

8. The engine for a leisure vehicle according to claim 7, wherein the controller is configured to determine a rate of decrease in the engine speed per unit time that is associated with the adjusting of the drive signal, based on the engine speed at that point of time such that the rate decreases as the engine speed decreases.

9. The engine for a leisure vehicle according to claim 1, wherein the predetermined position is a slight open position of the throttle valve.

* * * * *